US011512550B2

(12) United States Patent
Kvarme et al.

(10) Patent No.: US 11,512,550 B2
(45) Date of Patent: Nov. 29, 2022

(54) DELIVERING FLUID TO A SUBSEA WELLHEAD

(71) Applicant: CONOCOPHILLIPS COMPANY, Houston, TX (US)

(72) Inventors: Leif Kvarme, Tananger (NO); John Spence, Tananger (NO); Birger Heigre, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 17/100,081

(22) Filed: Nov. 20, 2020

(65) Prior Publication Data

US 2021/0189827 A1 Jun. 24, 2021

Related U.S. Application Data

(60) Provisional application No. 62/939,271, filed on Nov. 22, 2019.

(51) Int. Cl.

| | |
|---|---|
| ***E21B 19/16*** | (2006.01) |
| ***E21B 33/076*** | (2006.01) |
| ***E21B 34/04*** | (2006.01) |
| ***E21B 43/27*** | (2006.01) |
| ***E21B 19/00*** | (2006.01) |

(52) U.S. Cl.

CPC ..... *E21B 33/076* (2013.01); *E21B 19/004* (2013.01); *E21B 19/16* (2013.01); *E21B 34/04* (2013.01); *E21B 43/27* (2020.05)

(58) Field of Classification Search

CPC ..... E21B 19/16; E21B 33/076; E21B 34/04; E21B 43/27

See application file for complete search history.

(56) References Cited

U.S. PATENT DOCUMENTS

| | | | | |
|---|---|---|---|---|
| 4,730,677 | A * | 3/1988 | Pearce | E21B 17/015 166/345 |
| 6,536,528 | B1 * | 3/2003 | Amin | B63B 22/021 166/369 |
| 9,284,808 | B2 * | 3/2016 | Wright | H01L 27/1266 |
| 9,574,420 | B2 * | 2/2017 | Hall | E21B 17/20 |
| 9,695,665 | B2 * | 7/2017 | Older | E21B 33/076 |
| 10,487,608 | B2 * | 11/2019 | Shirani | E21B 43/12 |
| 2011/0061854 | A1 | 3/2011 | Davies | |
| 2012/0241174 | A1 | 9/2012 | Langeteig | |
| 2012/0273213 | A1 * | 11/2012 | Blalock | E21B 33/038 166/341 |
| 2016/0208570 | A1 | 7/2016 | Ayres et al. | |
| 2018/0038190 | A1 * | 2/2018 | Older | E21B 33/0387 |
| 2021/0002986 | A1 * | 1/2021 | Donald | E21B 43/0107 |

FOREIGN PATENT DOCUMENTS

WO 2012161585 A1 11/2012

* cited by examiner

*Primary Examiner* — Matthew R Buck

(74) *Attorney, Agent, or Firm* — ConocoPhillips Company

(57) ABSTRACT

The invention relates to the introduction of pressurized fluid, e.g. acid, into a subsea well directly from a vessel (33). A fluid injection assembly (20) is fitted to the top of a subsea Xmas tree (3), the assembly (20) including fail safe closed valve (21) which is controlled via a hydraulic line (31) from the vessel. The hose and assembly and valve are designed with an internal bore allowing a large diameter ball to be dropped (required for acid stimulation). The subsea subsea control module (8) on the Xmas tree is controlled from the producing platform.

18 Claims, 5 Drawing Sheets

DELIVERING FLUID TO A SUBSEA WELLHEAD

CROSS-REFERENCE TO RELATED APPLICATIONS

This application is a non-provisional application which claims benefit under 35 USC § 119(e) to U.S. Provisional Application Ser. No. 62/939,271 filed Nov. 22, 2019, entitled "DELIVERING FLUID TO A SUBSEA WELLHEAD," which is incorporated herein in its entirety.

STATEMENT REGARDING FEDERALLY SPONSORED RESEARCH

None.

FIELD OF THE INVENTION

This invention relates to the delivery of fluid, such as pressurized fluid, for example acid, to a hydrocarbon well via a wellhead installed on the seabed.

BACKGROUND OF THE INVENTION

In the process of extracting hydrocarbons (oil and/or gas) from a reservoir, it is often necessary to inject fluid into a hydrocarbon well. This could be for a number of reasons, including the injection of fluid to dissolve and remove unwanted scale build up (so called "scale squeeze") or the injection of heavy fluid ("kill fluid") to prevent production of hydrocarbons. Acid may also be injected for stimulating production from a formation.

For hydrocarbon production from chalk-type reservoirs, it is often necessary to improve the flowing capabilities in the reservoir by injecting acidic fluid into the reservoir rock. This is done by injecting fluid at high rate to create fractures and dissolve the near-bore formation in the reservoir. For hydrocarbon reservoirs under the seafloor, this type of operation is conventionally performed with a vessel with high rate/pressure pumping capabilities. For topside (dry tree) wells, where the Xmas tree is located on an offshore producing platform, this is done by connecting up to the well via the offshore platform. For subsea wells, where the Xmas tree is located on the seafloor (and the associated producing platform may be many kilometers away), high rate acid stimulation pumping is normally performed via a workover riser from a jack-up rig or semi-submersible rig.

A specialized vessel is brought to the jack up rig and a hose from the vessel inserted into a suitable connector on the rig to supply fluid from the vessel to the subsea well via the workover riser between the jack up and the subsea Xmas tree.

A workover riser is a riser that provides a conduit from the upper connection on the subsea tree to the surface, and which allows the passage of wireline tools and fluids into the wellbore. A workover riser can be run in open water without a drilling marine riser and therefore it shall be able to withstand the applied environmental forces, i.e. wind, waves and currents, or can be used in combination with drilling marine riser or a high pressure riser system.

A workover riser is typically used during the installation of the upper completion tubing hanger were wireline operations will be required during installation and testing of the upper completion and during wellbore re-entries which require full bore wireline tool access, it can also be used for the retrieval of the tubing hanger and production tubing. A workover riser typically consists of the following: the tubing hanger running tool; intermediate riser joints; lubricator valve(s) to isolate the riser during loading/unloading of long wireline tool strings; a surface tree for pressure control of the wellbore and to provide a connection point for a surface wireline lubricator system; and a means of tensioning the riser, so that it does not buckle under its own weight; a wireline or coiled-tubing BOP, capable of gripping, cutting and sealing coiled tubing or wireline.

For use on semi-submersible rigs it may also include a Subsea Test Tree and an emergency-disconnect package capable of high-angle release; retainer valve to retain the fluid contents of the riser during an emergency disconnect; a stress joint to absorb the higher riser bending stresses at the point of fixation to the Subsea Test Tree.

A workover riser is thus a complicated and heavy-duty piece of equipment which is designed to be used for a wide variety of operations, including the relatively simple process of injection of fluids into the production bore of a well. In addition, the daily cost of a jack up rig is very high. It would be preferable to be able to avoid the use of both a jack up rig and a workover riser and be able to inject fluid directly from the specialized vessel to the subsea well.

The inventors are aware of one system, described in European patent 2715046B1, for connecting a hose directly to a subsea Xmas tree. However, the inventors believe this system is unnecessarily complex, at least because it involves the subsea control module of a Xmas tree being taken over from the vessel. Also, it does not cater for the requirement to drop large diameter balls (normally required for acid stimulation).

The inventors are not aware of any existing equipment which could be used for acid stimulation by direct connection between a vessel (a so-called "stim vessel") and a subsea Xmas tree.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

BRIEF SUMMARY OF THE DISCLOSURE

The invention more particularly includes a pressurized fluid (e.g. acid) injection assembly as described in the appended claims, for example for delivery of fluid at rates detailed below.

The invention is suitable for, but not limited to, an apparatus and method for delivery of acid to a formation (acid stimulation). Acid is normally delivered at a high rate in comparison to other fluid. The apparatus is therefore, optionally, suitable for delivery of fluid at a rate of up to 15,000 liters per minute (or between 5,000 and 15,000 liters per minute), such as up to 15,000 liters per minute (or between 8,000 and 12,000 liters per minute), such as up to about 10,000 liters per minute. The method may include the step of delivering fluid, such as acid for acid stimulation, at a rate in these ranges.

A fail-safe close valve is a valve which is biased by some means to the closed position and requires active control, e.g. hydraulic pressure or an electric signal, to open it. A hose is a flexible conduit suitable for delivering fluid.

The second conduit and fail-safe close valve may have an unobstructed internal diameter of at least 4", such as 4" to 6", to allow a ball of 3-4" diameter, e.g. 3.5" or 3.75" diameter, to be dropped. This size is an industry standard, but the exact dimensions of the ball and unobstructed pathway are not central to the invention and a range of diameters for the pathway and ball are possible, e.g. from 2" to 10", such as from 3" to 8".

The invention also provides a system for injecting pressurized fluid (e.g. acid) into a subsea hydrocarbon well, as described in the appended system claims.

In once embodiment the invention provides a pressurized fluid (e.g. acid) injection assembly for mounting to a subsea Xmas tree, the Xmas tree having a first conduit communicating with production tubing of a subsea hydrocarbon well, the fluid injection assembly with a second conduit for delivery of fluid (e.g. acid) via the Xmas tree to the hydrocarbon well; a connector at a first end of the second conduit, for connecting the second conduit to the first conduit of the Xmas tree; a fail-safe close valve in the second conduit; and a fluid delivery connector for connecting to a fluid delivery pipe for supply of fluid to the injection assembly, the fluid delivery connector located at a second end of the second conduit.

In another embodiment the invention provides a system for injecting pressurized fluid (e.g. acid) into a subsea hydrocarbon well, the system with a subsea Xmas tree having a first conduit communicating with production tubing of a subsea hydrocarbon well; a fluid injection assembly as claimed in any of claims 1 to 5; a marine vessel including a fluid (e.g. acid) supply and a control unit; a fluid delivery pipe including a subsea connector at a first end for connecting to the fluid injection assembly and a connector at a second end for connecting to the fluid (e.g. acid) supply, optionally via a hose reel; and a control line extending between the fluid injection assembly and the control unit, for controlling the fail-safe close valve of the fluid injection assembly.

Additionally, the invention provides a method of delivering pressurized fluid (e.g. acid) to a subsea hydrocarbon wellhead, by removing a tree cap from a Xmas tree of a subsea well assembly; fitting a pressurized fluid (e.g. acid) injection assembly to the Xmas tree, the fluid injection assembly comprising a fail-safe close valve and a connector for a fluid delivery pipe; connecting a first end of fluid delivery pipe to the connector, a second end of the fluid delivery pipe being connected to a fluid supply apparatus installed on a marine vessel; and delivering fluid (e.g. acid) under pressure, via the fluid delivery pipe and fail-safe valve, to production tubing of a well via the Xmas tree, optionally wherein the fluid is delivered at a rate of between 5,000 and 15,000 litres per minute or up to 15,000 litres per minute, optionally between 8,000 and 12,000 litres per minute or up to 12,000 litres per minute, optionally up to 10,000 litres per minute.

A suitable fluid injection assembly may inject fluid at a rate of between 5,000 and 15,000 litres per minute or up to 15,000 litres per minute, optionally between 8,000 and 12,000 litres per minute or up to 12,000 litres per minute, optionally up to 10,000 litres per minute.

The second conduit and fail-safe close valve may have an unobstructed internal diameter of at least 4", such as 4" to 6". The second conduit may also include a rigid piping section having one or more bends of 90 degrees or more, whereby the fluid delivery connector is provided at an end of the rigid piping section. The fluid delivery pipe comprises a hose and a rigid connecting pipe having one or more bends of 60 degrees or more, such as 60 to 150 degrees, e.g. 80 to 110 degrees, the subsea connector being located on an end of the rigid connecting pipe, optionally wherein the rigid connecting pipe is releasably connected to the hose.

A fluid injection assembly may be designed such that the assembly is secured with respect to the seafloor, the fluid delivery connector is directed upwardly. The fluid delivery connector may also be adapted to receive lifting point member, whereby a lifting point for the assembly is provided. The fluid injection assembly may further comprising a guide funnel for guiding a fluid delivery pipe or lifting point member into position to connect to the fluid connector.

The Xmas tree includes a subsea control module for controlling at least a production master valve of the Xmas tree, the subsea control module being adapted to be controlled from a nearby production platform, optionally wherein no means is provided for control of the subsea control module directly from the vessel. The method may include lowering the pressurized fluid injection assembly into place on the Xmas tree by crane, using a lifting point member installed in the pressure hose connector of the assembly, and wherein the lifting point member may be removed. The second end of the hose may be connected via a quick release connector to the fluid supply apparatus via a hose reel or via some other structure.

A ball from the marine vessel may be dropped or pumped through the fluid delivery pipe and into the production tubing of the well.

The first end of the fluid delivery pipe may be lowered into position using a crane. Additionally, the fluid delivery pipe may comprise a hose and a rigid connecting pipe having one or more bends of 60 degrees or more, such as 60 to 150 degrees, e.g. 80 to 110 degrees, and the subsea connector being located on an end of the rigid connecting pipe, and wherein the hose is lowered into a bracket adjacent the Xmas tree; the connecting pipe is lowered to connect a first end of the connecting pipe to the hose; and connecting the subsea connector of the connecting pipe to the connector of the fluid injection assembly.

The fail-safe valve may be controlled from the marine vessel, optionally by maintaining the fail-safe valve open with positive hydraulic pressure on a hydraulic line from the vessel.

The production master valve and/or downhole safety valve associated with the Xmas tree may be controlled from the production platform.

The connector at the second end of the hose may be a quick release connector. The hose may include a weak link and/or swivel assembly and/or buoyancy modules.

The template may include a support bracket for the hose.

The invention also provides a method of delivering pressurized fluid to a subsea hydrocarbon wellhead, as described in the appended claims.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
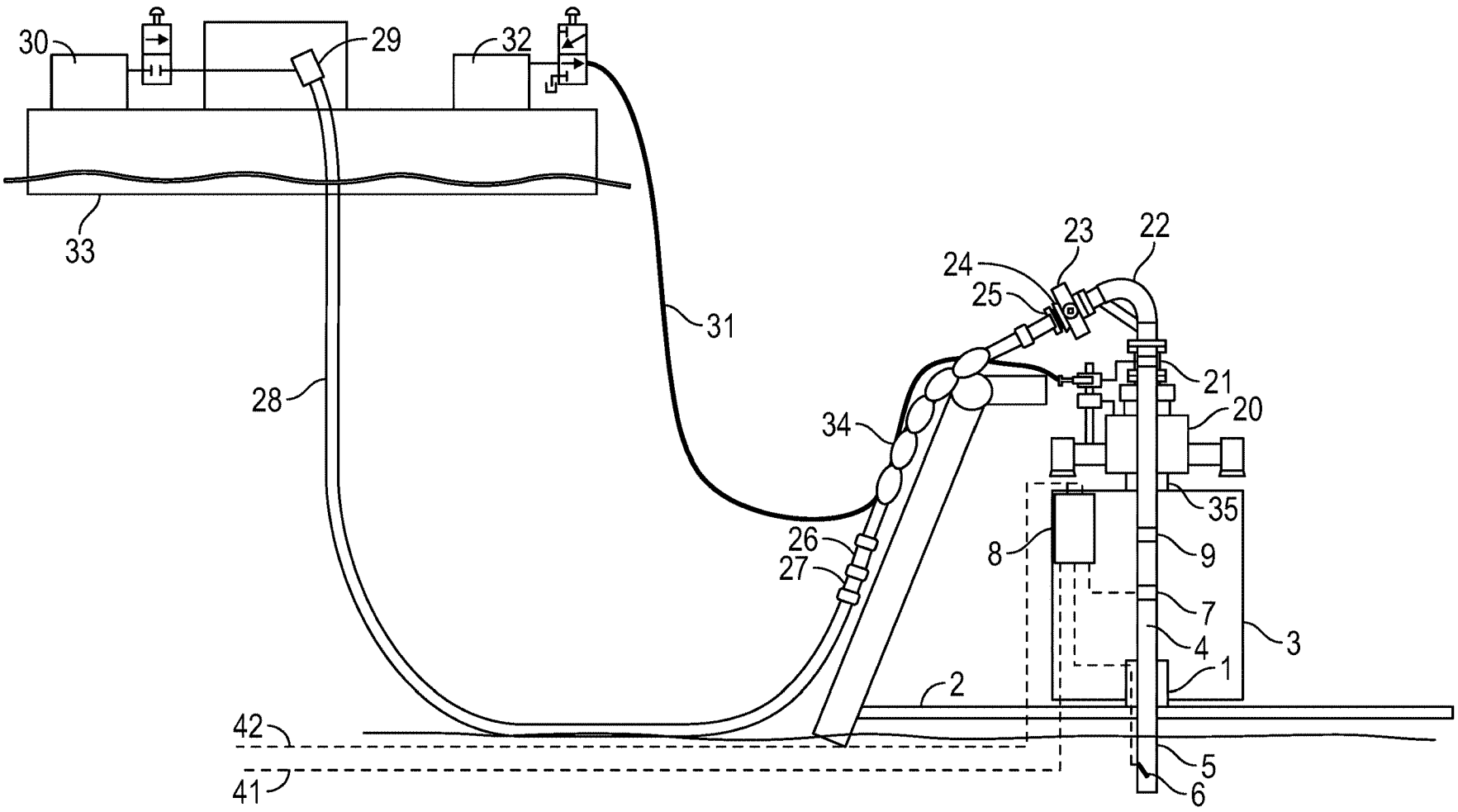
FIG. 1 is a schematic representation of a subsea template and Xmas tree connected to a stimulation vessel (not to scale), showing a first embodiment of the invention.

Referring to FIG. 1, a first embodiment of the invention will be described. A subsea wellhead 1, part of a subsea template 2 and Xmas tree 3 is shown. The template 2 serves more than one well (normally four), and a corresponding number of Xmas trees are mounted on the template one being shown at reference 3. The Xmas tree 3 is an assembly of conduits and valves, as is well known in the oil and gas field.

Referring to FIG. 1, an internal conduit 4 of the Xmas tree is connected via a seal sub assembly to the production tubing 5 of the well. In the production tubing is a downhole safety valve 6 and further up in the Xmas tree conduit is a production master valve 7. Both of these valves are operable via a subsea control module 8 which is in turn connected via a service umbilical and jumpers cables to the control room of a production platform from which the well is operated; this platform could be many kilometers away. The service umbilical and jumpers, and platform are not shown but are conventional, and include, e.g., electrical and/or optical fiber communications 42 and hydraulic supply 41.

Above the production master valve is the production swab valve 9, which is manually operated. In this subsea setting, the valve would normally be opened or closed by a work class subsea remote operated vehicle (WROV). At the top of the Xmas tree there would normally be a Tree cap, which provides protection to the Xmas tree re-entry hub and provides an additional mechanical well barrier; this is not shown in FIG. 1 but is entirely conventional.

All of the above description is conventional. Xmas trees may incorporate further valves, for example a second production master valve, but this is not relevant to the invention.

The connection to the production platform for the production of hydrocarbons from the well is not shown but is conventional: hydrocarbons that come up the production tubing are routed through the production bore of the Xmas tree and the flow control module, then leave the Xmas tree via a manifold hub pipework and are then routed into the manifold pipelines which feed into the production line to the platform.

FIG. 1 shows a pressurized fluid injection assembly 20 at the top of the Xmas tree. At the top of the Xmas tree is a re-entry hub 35 onto which an "H4 connector" (conventional in this art) locks; there is also an internal stinger (also conventional in this art).

The assembly is lowered onto the Xmas tree by crane and guided into position by a WROV, using the standard connections. The assembly 20 comprises a fail-safe close valve 21 and a gooseneck 22 to support the female hub 23 and to provide the correct angle and elevation to allow the complimentary male hub 25 of the hose 28 to be connected to the female hub 23 above the ITS structure (conventional in this art). The female connector 23 includes a guide funnel 24 to assist in attachment of the male connector fitting 25.

The hose is standard, flexible, high pressure hose, able to withstand pressures of up to 10,000 psi and to withstand acid and other chemicals which may be delivered down the hose.

The hose 28 and male hub 25 are lowered into position using a crane (not shown). Prior to making the connection, the production master valve (PMV) and downhole safety valve(s) (DHSV) are shut by signals from the production platform central control room (CCR). The production swab valve (PSV) is shut by direct manipulation by a WROV or potentially by divers using an ROV torque tool.

The connection between the hose and fluid injection assembly is then made by WROV, and the PMV, DHSV(s) and PSV opened. At this point, the communication between production tubing and the hose is controlled via the fail-safe close (FSC) valve 21 on the fluid injection assembly 20 installed on the Xmas tree. The FSC valve has a hydraulic control line 31 running up to a control unit 32 on the vessel 33. This valve is thereby controlled exclusively from the vessel. The fail-safe valve is of a standard gate valve design, incorporating a spring actuator to provide the means for the valve to move to the closed position if the hydraulic supply pressure is removed, as is well known in the oil and gas field.

The other end of the hose 28 is connected via a quick release connection 29 of known type to fluid supply apparatus 30 on board the vessel 33.

Figure 3:
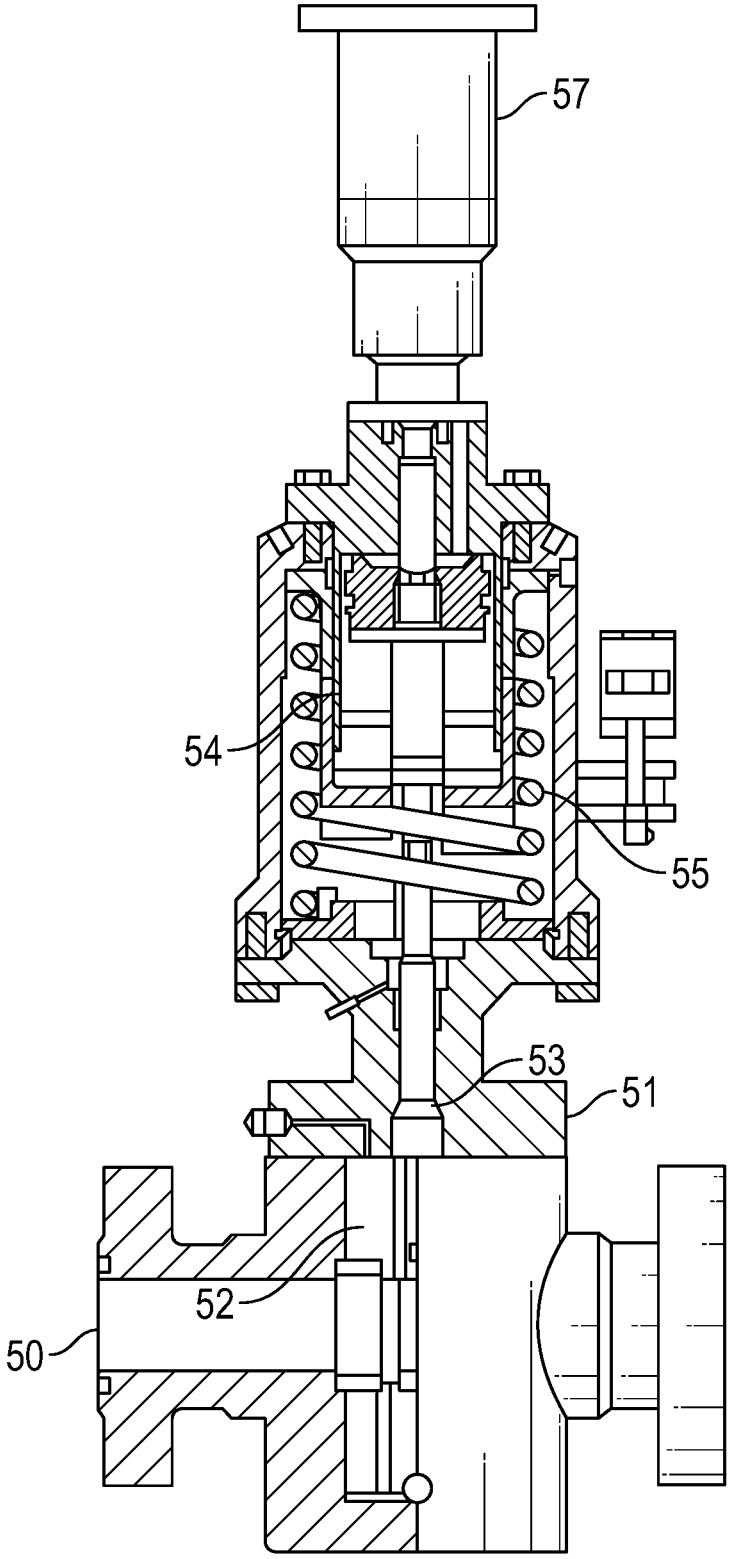
FIG. 3 is a part sectional view of an exemplary fail-safe valve.

In general terms, a fail-safe valve is a valve which will be in a closed configuration (thereby blocking/sealing a fluid channel) unless actively maintained in an open configuration by some means, e.g. hydraulic pressure or a applied electric voltage. Referring to FIG. 3, a typical fail-safe valve is shown. There are different types of such valve and the valve shown is merely one of many types which would be suitable for use in the invention. The valve is inserted in a fluid line having an open channel 50. The valve comprises a housing 51 defining a bore 52 perpendicular to and communicating with the channel 50. A valve member 53 is movable in the bore to block the channel 50. In FIG. 3 the valve is shown with the valve member 53 in an open configuration where it is retracted into the bore and does not block the channel 50.

The valve member 53 is connected to a hydraulic actuator 54. A supply of hydraulic fluid (not shown) is connected to the actuator via hydraulic connector 55. A spring 56 is arranged concentrically around the actuator 54 and biases the valve member into the closed position. The hydraulic actuator 54, when energized by pressurized hydraulic fluid, works against the force of the spring 56 in order to open the valve.

When fluid, such as acid, is to be delivered to the well, the FSC valve is opened from the vessel via a hydraulic control line 31, the PMV, PSV and DHSV(s) having all been opened previously.

The connection between the hose 28 and the fluid supply reel on the vessel is a quick release connector 29 and is designed such that if the vessel cannot remain in the correct position, e.g. due to weather conditions or a Drive off/Drift off scenario, an accumulator supplied, high pressure hydraulic fluid will be directed to the quick release connector and the hose quickly released and dropped from the hose reel. In this event the FSC valve on the fluid injection assembly 20 on the Xmas tree will also be closed as part of a programmed Emergency Quick Disconnect (EQD) logic sequence from the vessel.

It can be seen that the system can safely shut in the production bore and release the hose from the hose reel independent from the production platform. However, in normal operations, the Well Intervention Supervisor (WISU) located on the production platform who controls the PMV and DHSV(s) will be in full time communication with the vessel throughout the fluid pumping operations.

The vessel may be a specialized "stim vessel" carrying acid for acid stimulation, and a suitable pump. During acid stimulation, it is required to be able to drop one or more dissolvable balls from the stim vessel through the hose and through the production tubing to activate the injection assemblies installed in the reservoir liner which controls where the acid is finally delivered to the formation. This would normally be done via a workover riser which has sufficient clearance throughout the riser for balls to be dropped. In this system according to the invention, the use of a fail-safe close valve controlled by the stim vessel obviates the need for check valves which would otherwise obstruct the passage of a ball and potentially damage to the valves and the dissolvable balls preventing effective use.

More exemplary details of the system and method are provided below.

In one example, the invention provides a means of pumping acid from a stimulation vessel on surface via a pressure rated subsea hose directly into the vertical production bore of a vertical Xmas tree (VXT) and into the reservoir via the stim cap (or fluid injection assembly). The following equipment may be used:

An external connector of the "H4" type and a fail-safe close (FSC) valve controlled by direct hydraulic pressure via a hose from the stim vessel;

In the VXT, a manual production swab valve (PSV) operated by an ROV torque tool, a production master valve (PMV), controlled from the host platform central control room (CCR);

Contained in the upper completion of the well, the down hole safety valves (DHSV), controlled from the host platform CCR;

Pre-installed production tubing and reservoir liner in the well.

The purpose of this operation is to allow acid to be pumped at high pressure and at a high flow rate into the formation rock via the production bore (first conduit) of the VXT and production tubing and reservoir liner, to acid frac and dissolve the formation rock to increase to the flow rate of hydrocarbons back into the reservoir liner during production.

A description of an exemplary method is provided below.

The pre-installed internal tree cap is first recovered to surface from the VXT and replaced with an external H4 connector/stim cap assembly, an interface VX gasket installed between the H4 connector, and then the VXT re-entry hub is pressure tested.

The stim hose assembly (minimum 4" ID with no restrictions or check valves in-line) is connected to a swivel 27 using a grayloc connector (conventional in this art).

The swivel is complete with a weak link sub 26 and male connector; this is lowered subsea and locked onto the SeAlign female hub of the pre-installed stim cap assembly.

The FSC is opened from the vessel, the PSV is opened using an ROV torque tool, the PMV and DHSV's are opened from the Production platform CCR via a subsea control module (SCM) installed on the VXT.

When required, a dissolvable ball up to 3.75" diameter is inserted into a stim hose manifold located upstream of a stim hose reel on the vessel, the ball is then pumped through the stim hose, stim cap, VXT production bore, production tubing and reservoir liner onto the ball seat of a sliding sleeve assembly that has been pre-installed in the reservoir liner.

Acid is then pumped under high pressure (up to 7,500 psi) to push on the ball seat, which in turn pushes the sliding sleeve to an open position, allowing the acid to be pumped through open ports into the formation rock. Acid stimulation pumping operations can then commence (min. flow rate of 60 Barrels/min required for these stim operations.)

At the end of the stimulation operations, the well is shut-in from the platform CCR, by closing the DHSV & PMV, then closing the PSV using the ROV Torque Tool.

The stim hose and stim cap are then disconnected and recovered to surface, the internal tree cap is then reinstalled into the VXT and pressure tested, in accordance with equipment manufacturers procedures.

In this example, the components of the stim. cap include the following:

H4 External Connector, to externally lock and seal the connector onto the VXT Re-entry hub using an 18¾" VX gasket to make a seal between the 2 elements;

H4 Connector: upper assembly is an RLWI adaptor, with a 13⅝" 10 k SL-215 connector, which provides an interface for the FSC valve to be connected to the top of the RLWI adaptor installed on top of the H4 Connector;

H4 Connector: internal lower connection is a production seal stab, used to guide a dropped ball directly into the production bore of the VXT; the production seal stab also provides a pressure retaining connection between the production bore of the VXT and the Stim hose via the stim cap assembly;

Fail safe closed valve (FSC): to provide a means to shut-in and seal the well bore independently from the platform control, this valve is controlled directly from various locations onboard the stim vessel; The FSC valve also acts as an adaptor crossover assembly from SL-215 speedlok—API flange;

Gooseneck/bend restrictor to direct the stim hose above the ITS structure and down towards the seabed and maintain the hose minimum bend radius;

The female SeAlign hub is complete with a primary guidance funnel to assist with the alignment of the stim hose male hub and incorporates the connector locking mechanism and retention pins to be used during installation of the male hub.

Male SeAlign connector hub provides an interface between the stim hose and the female hub mounted on the gooseneck on the preinstalled Stim cap assembly, it also carries a changeable seal ring that is located between the male and female hubs;

Male SeAlign connector: does not have a quick release function, as it is not required for this application since the quick release system is provided at the hose reel;

A weak link assy. To provide a pressure balanced weak link to reduce the potential for damage to the subsea asset in the event of the vessel not keeping station and the hose reel connector not releasing the hose.

Swivel to allow for rotation of the hose to remove any torque induced during hose deployment when installing the male hub into the female hub on the stim cap assy.;

Greyloc connector to provide the interface between the Stim hose and the Swivel;

Buoyancy modules 34, to assist with installation of male hub into female hub and to protect the paintwork of the ITS structure;

Hydraulic connector (EQD) to secure the hose male connector to the reel located on the deck of the stim vessel;

Ball drop pressure retaining manifold, to allow for the insertion of various sized dissolvable balls when required.

In this example, the following well barriers are provided:

Primary barrier element is the DHSV, fail-safe close (FSC) flapper type valve, controlled from the host platform CCR, via radio/telephone under instruction from the well intervention supervisor (WISU);

2$^{nd}$ Barrier element is the PMV (FSC), controlled from the host platform CCR, via radio/telephone under instruction from WISU;

3$^{rd}$ Barrier element, is the PSV, (Manual operated valve by ROV torque tool), under instruction from WISU;

4$^{th}$ Barrier element is the stim cap (FSC) valve, controlled directly from the stim vessel, on instruction from WISU or if required during a vessel positioning event.

In this example, the following actions may be taken to ensure safe operation in the event of the vessel drifting off or a similar situation:

1. Immediately stop acid pumping operations
2. Shut-in the well by closing the stim cap FSC valve from the stim vessel to shut-in the well bore
3. Notify the platform via radio/phone call to shut the PMV and DHSV valves
4. If vessel cannot keep within the "watch circle", open the female hydraulic connector on the stim reel to allow the male connector of the stim hose to be released from the reel to drop the open-ended stim hose, complete with its attached buoyancy block into the sea. This eliminates the requirement for an EQD (Emergency Quick Disconnect) connector installed between the stim hose male SeAlign connector and the stim cap.

Figure 2:
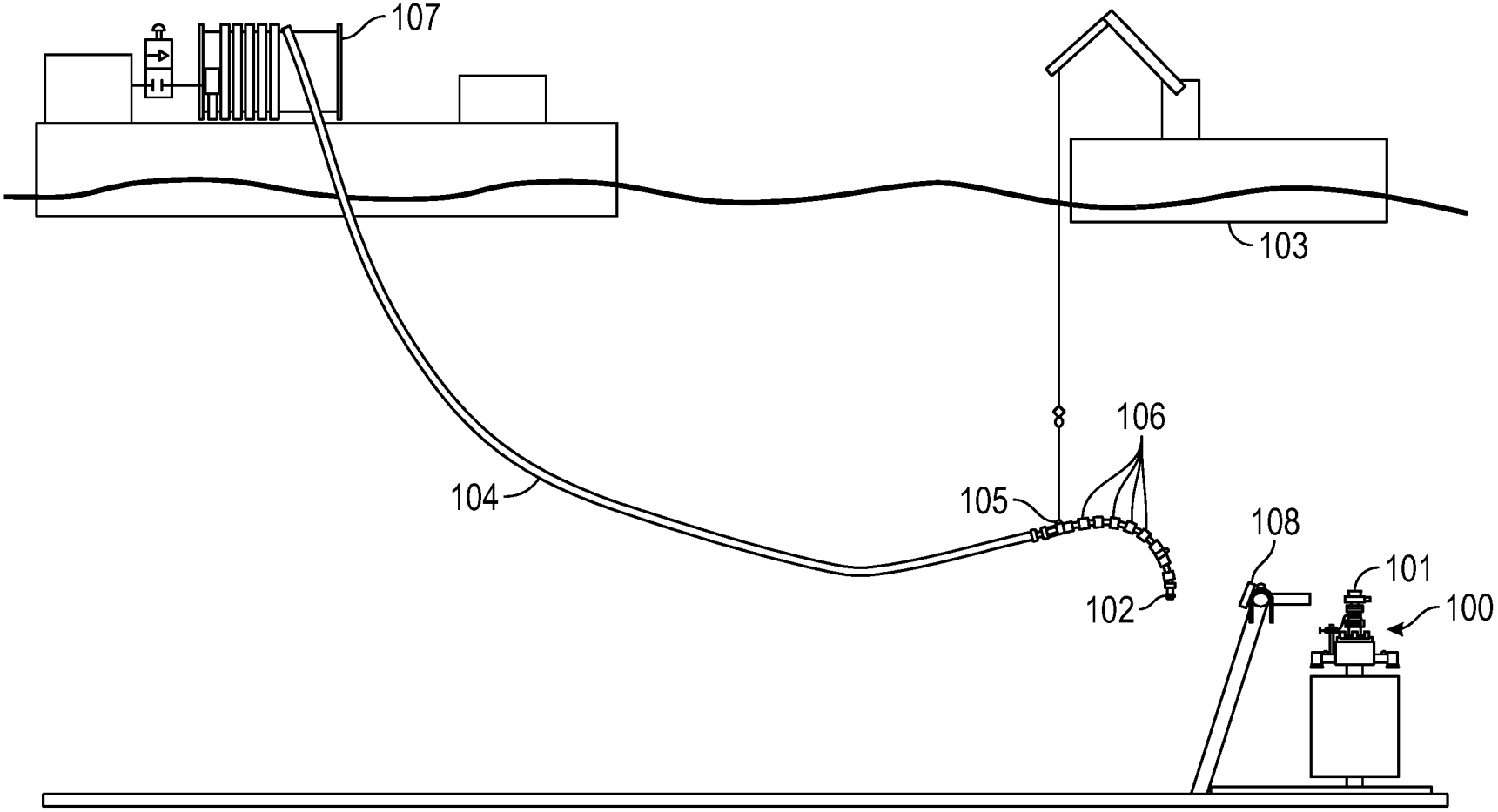
FIG. 2 is a representation similar to FIG. 1 showing a second embodiment of the invention.

A second embodiment in accordance with the invention is shown in FIG. 2. In most respects, the second and first embodiments work in the same way, but the second embodiment involves an improved design of system for lifting the fluid injection cap assembly into place and subsequently connecting the hose to the cap assembly.

Where parts in FIG. 2 are not referenced or are omitted completely, they are the same as in FIG. 1.

The principal difference between the first and second embodiments is that the fluid injection assembly ("stim cap") 20 of FIG. 1, including gooseneck 22, is replaced by a fluid injection assembly 100 which has an upwardly oriented female hub/connector 101 and no gooseneck feature. This has two advantages: (i) the vertically upward orientation of the hub 101 means that it is considerably easier to attach the hose connector 102, and (ii) during installation of the stim cap assembly 100 on the Xmas tree, a lifting point apparatus (not shown) can be locked into the hub to allow the stim cap assembly to be lowered by crane onto the Xmas tree.

In FIG. 2, the stim cap assembly is shown in place on the Xmas tree, after having been installed by a floating crane 103 using lifting point apparatus (not shown) locked into the hub 101. In FIG. 2, the lifting point apparatus has been removed from the hub, and the floating crane 103 is shown in the process of installing the hose 104. Unlike the first embodiment which requires two lifting points, the crane cable is attached to the hose 104 at a single lifting point 105.

The hose 104 is fitted with a series of bend restrictor elements 106 which prevent the hose from kinking. The lifting point 105 is at one end of the bend restrictors 106 with the end connector 102 hanging down on one side, and the remainder of the hose 104 on the other side. The crane and the hose reel 107 can be worked together to ensure that the hose connector 102 is hanging vertically when it is brought into engagement with the hub 101. The connection with the hub 101 is then locked using known means (not shown) by an ROV (also not shown).

The hose 104 is then placed into a supporting bracket 108 on the template structure, and the weight of the remainder of the hose trailing on the seafloor is sufficient to keep the hose from moving and stressing the connection.

The fluid injection (e.g. acid stimulation) operation is then conducted in exactly the same way as described in relation to the first embodiment.

Figure 4:
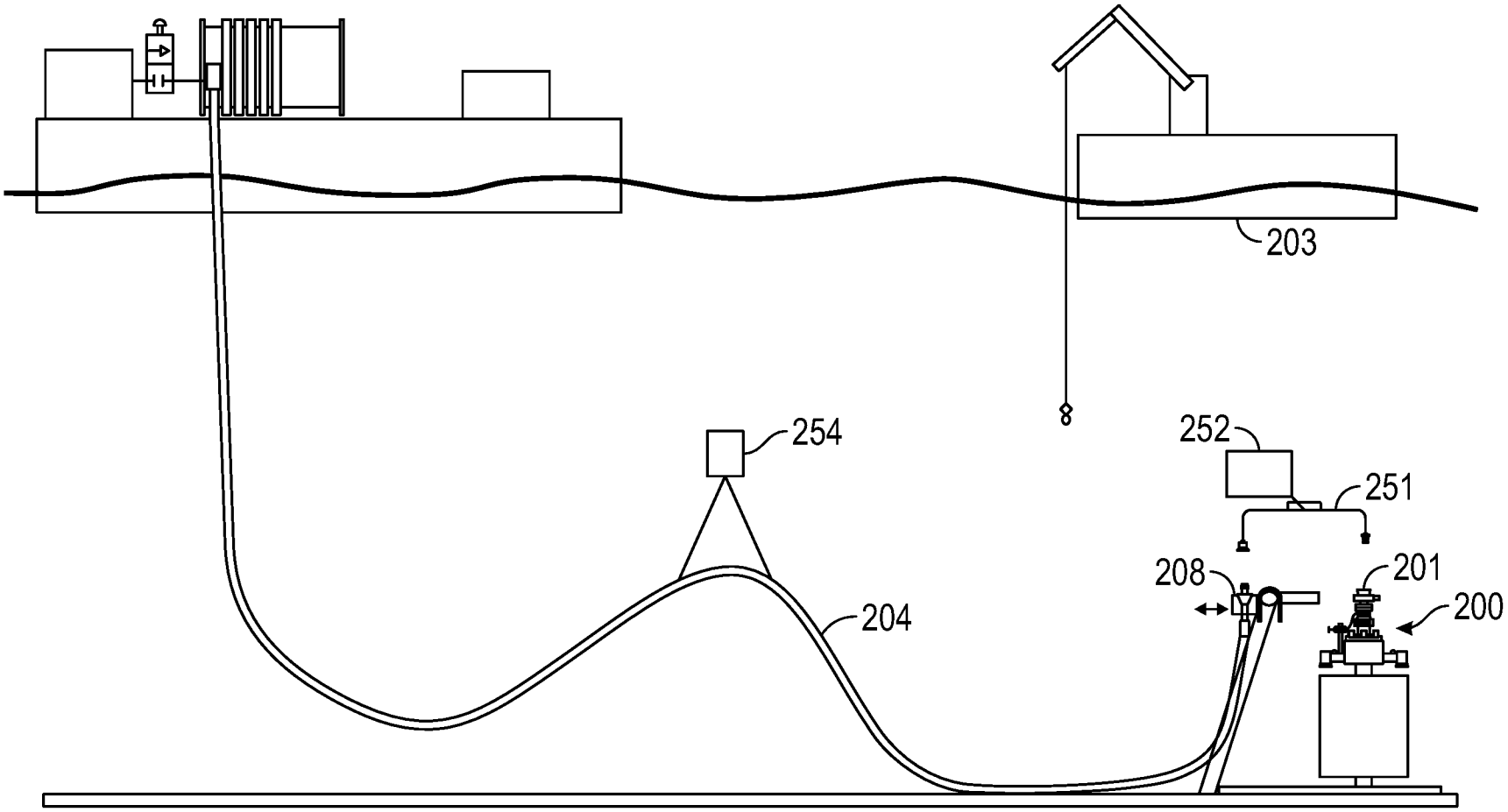
FIG. 4 is a representation similar to FIG. 3 showing a third embodiment of the invention.
Figure 5:
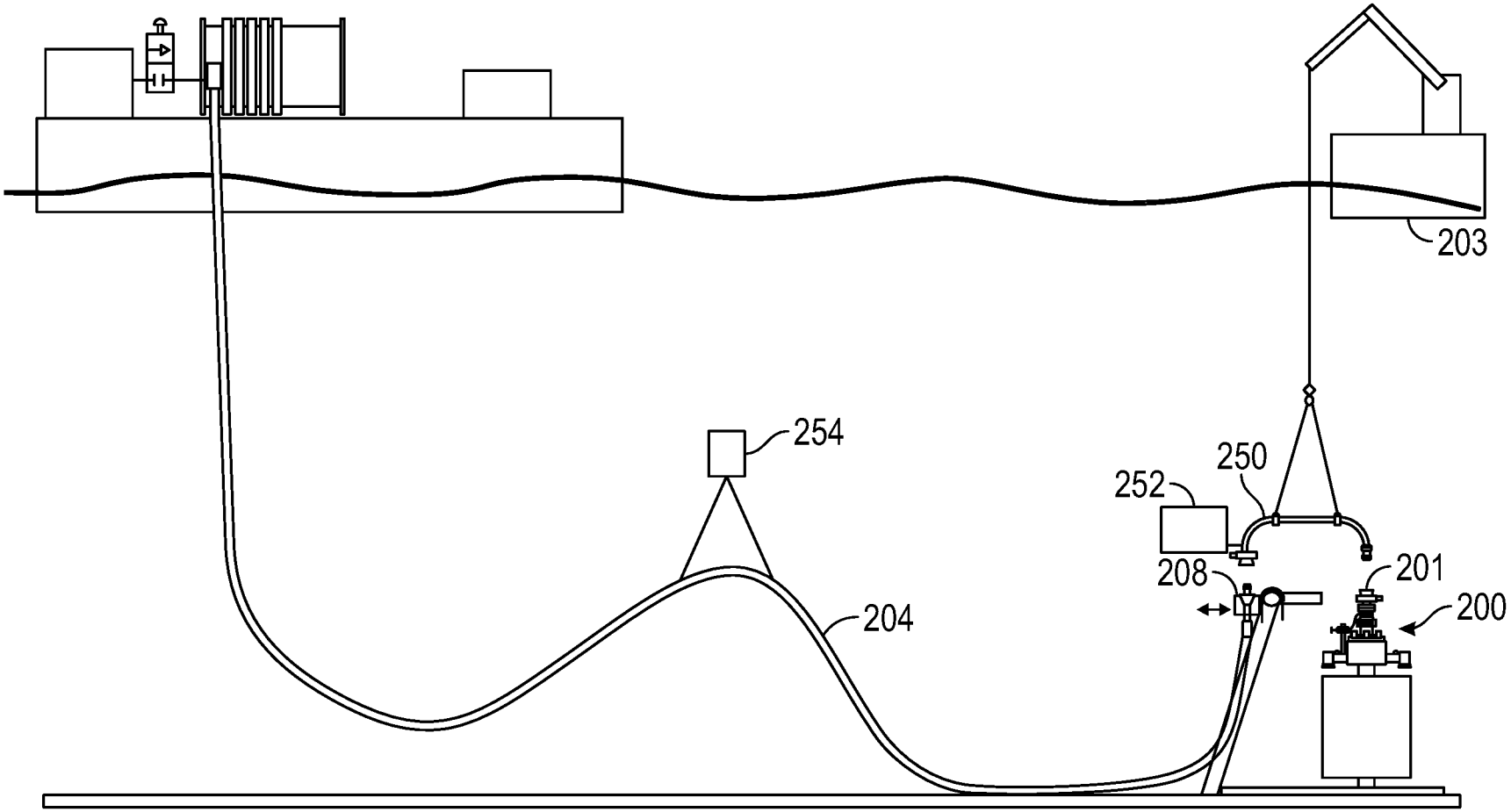
FIG. 5 s a representation similar to FIG. 3 showing the third embodiment of the invention at a different stage in the process of attaching the hose.

A third embodiment in accordance with the invention is shown in FIGS. 4 and 5. In most respects, the third embodiment works in the same way as the second and first embodiments, but the third embodiment involves an improved design of system for connecting the hose to the fluid injection cap assembly.

Where parts in FIGS. 4 and 5 are not referenced or are omitted completely, they are the same as in FIG. 2.

The principal difference between the second and third embodiments is that the hose 204 is attached to the supporting bracket 208 such that the open end of the hose faces upwardly in the bracket 208. The connection between the secured end of the hose 204 and the hub 201 of the stim cap assembly 200 is then achieved by means of a rigid connector pipe 250 (shown in FIG. 5). The connector pipe 250 has two 90 degree bends enabling it to attach between the upwardly directed connector of the stim cap assembly and the upwardly directed end of the hose.

Prior to mounting the connector pipe 250, the exact distance between the secured hose end and the hub 201 is measured using a measuring device 251 which is brought up to the hose end and hub 201 by R.O.V. 252 (see FIG. 4). The bracket 208 of the third embodiment has a different design to that of the second embodiment, that allows the bracket 208 to be adjusted (by R.O.V.) to alter the position of the hose end so that the distance between hose end and hub 201 can be set. The measuring device 251 is then removed and the rigid connector 250 lifted into position using the crane 203 in combination with R.O.V. 252.

A buoyancy element 254 is attached to a point or points along the length of the hose 204 to reduce stresses on the hose 204 and bracket 208.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

EP2715046B 1 Subsea Systems

The invention claimed is:

1. A pressurized fluid injection assembly suitable for lowering onto and mounting to a top of a subsea Xmas tree, the Xmas tree having a first conduit communicating with production tubing of a subsea hydrocarbon well, the fluid injection assembly comprising:

a second conduit for delivery of fluid via the Xmas tree to the hydrocarbon well;

a connector at a first end of the second conduit, for connecting the second conduit to the first conduit of the Xmas tree;

only a single valve in the second conduit, wherein the valve is a fail-safe close valve;

wherein the second conduit and the fail-safe close valve have an unobstructed internal diameter of at least 4";

a fluid delivery connector for connecting to a fluid delivery pipe for supply of fluid to the injection assembly, the fluid delivery connector located at a second end of the second conduit.

2. The fluid injection assembly according to claim 1, suitable for injection of fluid at a rate between 5,000 and 15,000 liters per minute.

3. The fluid injection assembly according to claim 1, wherein the second conduit includes a rigid piping section having one or more bends of 90 degrees or more, whereby the fluid delivery connector is provided at an end of the rigid piping section.

4. The fluid injection assembly according to claim 1, wherein, when the assembly is secured with respect to the seafloor, the fluid delivery connector is directed upwardly.

5. The fluid injection assembly according to claim 4 wherein the fluid delivery connector is also adapted to receive lifting point member, whereby a lifting point for the assembly is provided.

6. The fluid injection assembly according to claim 1, further comprising a guide funnel for guiding a fluid delivery pipe or lifting point member into position to connect to the fluid connector.

7. A system for injecting pressurized fluid into a subsea hydrocarbon well, the system comprising:

a subsea Xmas tree having a first conduit communicating with production tubing of a subsea hydrocarbon well;

a fluid injection assembly mounted on top of the subsea Xmas tree, the fluid injection assembly comprising: (i) a second conduit for delivery of fluid via the Xmas tree to the hydrocarbon well; (ii) a connector at a first end of the second conduit, for connecting the second conduit to the first conduit of the Xmas tree; (iii) the second conduit having only a single valve, wherein the valve is a fail-safe close valve, and wherein the second conduit and the fail-safe close valve have an unobstructed internal diameter of at least 4"; (iv) a fluid delivery connector for connecting to a fluid delivery pipe for supply of fluid to the injection assembly, the fluid delivery connector located at a second end of the second conduit;

a marine vessel including a fluid supply and a control unit;

a fluid delivery pipe including a subsea connector at a first end for connecting to the fluid injection assembly and a connector at a second end for connecting to the fluid supply;

a control line extending between the fluid injection assembly and the control unit, for controlling the fail-safe close valve of the fluid injection assembly.

8. The system according to claim 7, suitable for injection of fluid at a rate between 5,000 and 15,000 liters per minute.

9. The system according to claim 7, wherein the fluid delivery pipe has an unobstructed internal diameter of at least 4".

10. The system according to claim 7, wherein the fluid delivery pipe comprises a hose and a rigid connecting pipe having one or more bends of 60 degrees or more, the subsea connector being located on an end of the rigid connecting pipe, wherein the rigid connecting pipe is releasably connected to the hose.

11. The system according to claim 7, wherein the Xmas tree includes a subsea control module for controlling at least a production master valve of the Xmas tree, the subsea control module controllable from a nearby production platform, and wherein no means is provided for control of the subsea control module directly from the vessel.

12. A method of delivering pressurized acid to a subsea hydrocarbon wellhead, the method comprising:

a. removing a tree cap from a Xmas tree of a subsea well assembly;

b. mounting a pressurized fluid injection assembly on top of the Xmas tree, the fluid injection assembly comprising a connector for a fluid delivery pipe and only a single valve, wherein the valve is a fail-safe close valve;

c. connecting a first end of a fluid delivery pipe to the connector, a second end of the fluid delivery pipe being connected to a fluid supply apparatus installed on a marine vessel;

d. delivering acid under pressure, via the fluid delivery pipe and the fail-safe valve, to production tubing of a well via the Xmas tree;

e. controlling the fail-safe valve from the marine vessel;

f. controlling from a production platform a production master valve and/or downhole safety valve associated with the Xmas tree;

g. including the step of dropping or pumping a ball from the marine vessel through the fluid delivery pipe and into the production tubing of the well.

13. The method according to claim 12, wherein step b includes lowering the pressurized fluid injection assembly into place on the Xmas tree by crane, using a lifting point member installed in the connector of the assembly, and wherein the lifting point member is removed prior to step c.

14. The method according to claim 12, wherein the second end of the fluid delivery pipe is connected via a quick release connector to the fluid supply apparatus via a hose reel or via some other structure.

15. The method according to claim 12, wherein step c is performed by lowering the first end of the fluid delivery pipe into position using a crane.

16. The method according to claim 12, wherein the fluid delivery pipe comprises a hose and a rigid connecting pipe having one or more bends of 60 degrees or more, and a subsea connector being located on an end of the rigid connecting pipe, and wherein step c is performed by:

(i) lowering the hose into a bracket adjacent the Xmas tree;

(ii) lowering the connecting pipe;

(iii) connecting a first end of the connecting pipe to the hose;

(iv) connecting the subsea connector of the connecting pipe to the connector of the fluid injection assembly.

17. The method according to claim 12, maintaining the fail-safe valve open with positive hydraulic pressure on a hydraulic line from the vessel.

18. The method according to claim 12, wherein the acid is delivered at a rate between 5,000 and 15,000 litres per minute.

* * * * *